US008605004B2

(12) United States Patent
Legare

(10) Patent No.: US 8,605,004 B2
(45) Date of Patent: Dec. 10, 2013

(54) DYNAMICALLY RECONFIGURABLE MICROSTRIP ANTENNA

(75) Inventor: David J. Legare, Ava, NY (US)

(73) Assignee: The United States of America as represented by the Secretary of the Air Force, Washington, DC (US)

( * ) Notice: Subject to any disclaimer, the term of this patent is extended or adjusted under 35 U.S.C. 154(b) by 206 days.

(21) Appl. No.: 13/385,469

(22) Filed: Jan. 24, 2012

(65) Prior Publication Data

US 2013/0063325 A1 Mar. 14, 2013

Related U.S. Application Data

(60) Provisional application No. 61/573,886, filed on Sep. 12, 2011.

(51) Int. Cl.
*H01Q 1/50* (2006.01)
*H01Q 3/24* (2006.01)
*H01Q 21/00* (2006.01)

(52) U.S. Cl.
USPC ..... 343/906; 343/876; 343/853; 343/893; 343/904; 343/810

(58) Field of Classification Search
None
See application file for complete search history.

(56) References Cited

U.S. PATENT DOCUMENTS

| | | | | |
|---|---|---|---|---|
| 6,037,903 | A * | 3/2000 | Lange et al. | 343/700 MS |
| 6,087,991 | A * | 7/2000 | Kustas | 343/700 MS |
| 6,198,438 | B1 * | 3/2001 | Herd et al. | 343/700 MS |
| 8,537,059 | B2 * | 9/2013 | Sauer et al. | 343/705 |
| 2005/0179614 | A1 * | 8/2005 | Nagy | 343/909 |
| 2006/0164309 | A1 * | 7/2006 | Fujishima et al. | 343/700 MS |

* cited by examiner

*Primary Examiner* — Trinh Dinh
(74) *Attorney, Agent, or Firm* — Joseph A. Mancini

(57) ABSTRACT

A dynamically-reconfigurable antenna having a microstrip patchwork radiating surface wherein individual radiating patches can be connected to and disconnected from each other via photoconductive interconnections between the radiating patches. Commands from software alternately turn light from light emitting sources on or off, the light or lack thereof being channeled from an underside layer of the antenna so as to enable or disable the photoconductive interconnections. The resultant connection or disconnection of the radiating patches will vary the antenna's frequency, bandwidth, and beam pointing.

15 Claims, 2 Drawing Sheets

DYNAMICALLY RECONFIGURABLE MICROSTRIP ANTENNA

PRIORITY CLAIM UNDER 35 U.S.C. §119(e)

This patent application claims the priority benefit of the filing date of provisional application Ser. No. 61/573,886, having been filed in the United States Patent and Trademark Office on Sep. 12, 2011 and now incorporated by reference herein.

STATEMENT OF GOVERNMENT INTEREST

The invention described herein may be manufactured and used by or for the Government of the United States of America for governmental purposes without the payment of any royalty thereon.

BACKGROUND OF THE INVENTION

1. Technical Field of the Invention

This invention relates generally to the field of communications antennas. More specifically the present invention relates to electronically reconfigurable and beam-steered planar antenna structures.

2. Background

The development of antennas for use on moving platforms such as aircraft and ground vehicles has not been particularly difficult for low frequency applications where near-omnidirectional antenna beam patterns provide sufficient radio frequency (RF) gain. However, at higher frequencies an air or ground vehicle antenna must possess a degree of spatial directionality to achieve sufficient gain to close transmit and receive communications links.

Spatially-directional antennas used in air and ground vehicle applications must also have beam steering capabilities in order to maintain line-of-sight communications. Where the dynamics are not too great, beam steering on moving platforms has been accomplished by mechanical steering means. However, when platform dynamics are high, electronic beam phase-shift steering is the only means that will suffice.

When airborne antenna applications will have an adverse impact on aerodynamics, planar, electronically phase-shift steered antennas represent the only viable solution because they afford integration into the airframe with minimal disturbance to airflow. Conformal antennas provide the ultimate solution to integration into an airframe because conformal arrays can be shaped to match portions of an aircraft such as fuselages and even wing leading edges. The application of multiple conformal arrays also relaxes the requirements for phase steering because at any given time the conformal array pointed being oriented nearest to boresight can be selected to carry the communications link.

Moreover, because antennas are generally designed to operate at a given relatively narrow frequency band, by design, their operational frequency range is generally fixed. Wide bandwidth antennas solve the problem of having to integrate a separate system of antenna arrays into an aircraft for each frequency band of interest. To the extent that a single antenna array can be reconfigured in real time to support multiple frequency bands of operation, the better in terms of power, weight, and space.

What is needed therefore is a communications antenna system and structure that provides real time control over electronic beam steering and operational frequency band, while possessing a simple planar structure with adaptability to conformal integration with a host platform.

The Prior Art

Non-patent reference to Maloney et al [1] discloses a method that addresses the physical size of antenna arrays by employing "fragmented aperture" techniques to provide controlled reception pattern antenna arrays having one-quarter the footprint of conventional to arrays. Finite difference time domain code is applied to computationally model the fragmented aperture for optimization over gain, steering, bandwidth, and physical dimension. While apparently successful in reducing array size for a given bandwidth, the fragmented aperture technique does not provide the flexibility afforded by real time reconfigurability of either parameter.

Non-patent reference to Georgia Institute of Technology [2] discloses a method that apparently creates a bandwidth of 33-to-1 in a planar antenna array of given size by exploiting the properties of mutual coupling between antenna elements. However, nothing in this reference indicates that mutual coupling, and therefore bandwidth, may be varied in real time or that the mutual coupling properties are not dependent upon antenna structure planarity, so as to make amenable to conformal applications.

Non-patent reference to Syntonics, LLC entitled Pixel-Addressable Reconfigurable Conformal Antenna (PARCA Software Defined Antenna™) [3] discloses a method for dynamically adjusting the operating frequency, beamwidth, and polarization while transmitting. The PARCA™ employs movable, millimeter-scale, microstrip transmission line pixels with uniform size and dimension to create a rapidly, pixel-by-pixel, changeable antenna pattern upon command. While this reference apparently provides real time control of beam steering and bandwidth with adaptability to conformal applications, the method of operation requires the physical movement of microstrip pixels into and out of alignment with the radiating elements' plane, with no disclosed means for providing such movement.

Non-patent reference to Pringle et al [4] discloses a reconfigurable antenna array employing field effect transistors (FETs) as switches that interconnect radiating patches on the antenna's surface. To reduce control signal routing, the FETs are overlaid by a corresponding array of light emitting diodes (LEDs). The LED light illuminates a photo-detector in parallel with the gate-source junction of the FET, causing the gate source voltage to drop thereby opening the FET switch so as to connect an adjacent radiating patch. As many radiating patches as are interconnected will define the instant configuration of the antenna. While this reference represents an advancement in the state-of-the-art of reconfigurable antennas it has not overcome the necessary complexity of routing bias voltages to each and every FET, nor the associated power consumption. Additionally, the reference discloses that FET switches cause signal losses at microwave frequencies and that the metallic bias lines to each FET introduce scattering that distorts the antenna pattern.

What the prior art fails to provide and what is needed, therefore, is an antenna which (1.) is steerable and reconfigurable in terms of operating bandwidth and radiation pattern; (2.) planarized yet suitable for conformal applications; and (3.) is minimally dependent upon active circuitry and physical and electrical interconnections that create signal loss and antenna distortion.

OBJECTS AND SUMMARY OF THE INVENTION

It is therefore an object of the present invention to provide an antenna which is electronically reconfigurable in operating frequency and bandwidth.

It is a further object of the present invention to provide an antenna which is electronically controllable in beam shape and pointing direction.

It is still a further object of the present invention to provide an antenna which features a thin, planarized construction.

It is yet still a further object of the present invention to provide an antenna meeting all of the above objectives yet is adaptable to conformal installations on air, land, and sea vehicles.

An additional object of the present invention is to overcome the complexity of prior art physical and electrical interconnections between control structures and radiating structures.

Briefly stated, the present invention achieves these and other objects by providing an antenna having a microstrip patchwork radiating surface wherein individual radiating patches can be connected to and disconnected from each other via photoconductive interconnections between the radiating patches. Commands from software alternately turn light from light emitting sources on or off, the light or lack thereof being channeled from an underside layer of the antenna so as to enable or disable the photoconductive interconnections. The resultant connection or disconnection of the radiating patches will vary the antenna's frequency, bandwidth, and beam pointing.

In a fundamental embodiment of the present invention, an antenna has a radiating layer, a ground plane layer, and a control layer where the radiating layer further has a plurality of radiating elements, and a means for establishing and de-establishing electrical connectivity between adjacent said radiating elements, and a means for connection to a radio frequency transmission/reception medium. The control layer has a plurality of means for producing and transmitting a control signal to said means for establishing and de-establishing electrical connectivity. The ground plane layer cooperates between the radiating layer and the control layer so as to facilitate the propagation of the control signal.

Still according to a fundamental embodiment of the present invention, an antenna has a top layer with a plurality of radiating elements, an array of photoconductive interconnections disposing an interruptible electrical pathway between adjacent radiating elements, and a means for connection to a radio frequency transmission/reception medium. Antenna also has a bottom layer comprising a like array of light emitting sources and a middle layer ground plane having a like array of light-transmissive channels. Each of the photoconductive interconnections, each of the light emitting sources, and each of the light-transmissive channels are oriented so as to permit light from a light emitting source to pass through a corresponding light-transmissive channel, and into a corresponding photoconductive interconnection. Each of the light emitting sources is individually computer software controlled.

The above and other objects, features and advantages of the present invention will become apparent from the following description read in conjunction with the accompanying drawings, in which like reference numerals designate the same elements.

REFERENCES

[1] J. Maloney, B. Baker, J. Acree, J. Schultz, J. Little, D. Reuster, "Fragmented Aperture Antenna Design of Miniaturized GPS CRPA: Model and Measurements", pp. 3784-3787, IEEE, 2007.

[2] "100-to-1 Bandwidth: New Planar Design Allows Fabrication of Ultra Wideband Phased Array Antennas", Georgia Institute of Technology, May 9, 2006.

[3] "PARCA (Pixel-Addressable Reconfigurable Conformal Antenna)", Syntonics, LLC, http://www.syntonicscorp-.com/products/documents/Syntonics_PARCA_Narrative-Bri efing.pdf

[4] L. Pringle, P. Harms, S. Blalock, G. Kiesel, E. Kuster, P. Friederich, R. Prado, J. Morris, "The GTRI Prototype Reconfigurable Aperture Antenna", pp. 683-686, IEEE, 20003.

DETAILED DESCRIPTION OF THE PREFERRED EMBODIMENT

The present invention describes the design and fabrication of a planar antenna featuring a set of microstrip elements which can be dynamically interconnected and de-interconnected so as to re-pattern the radiating structure of the antenna in order to tune it over a broad frequency band, as well as produce a wide range of beam shapes and pointing directions.

Figure 1:
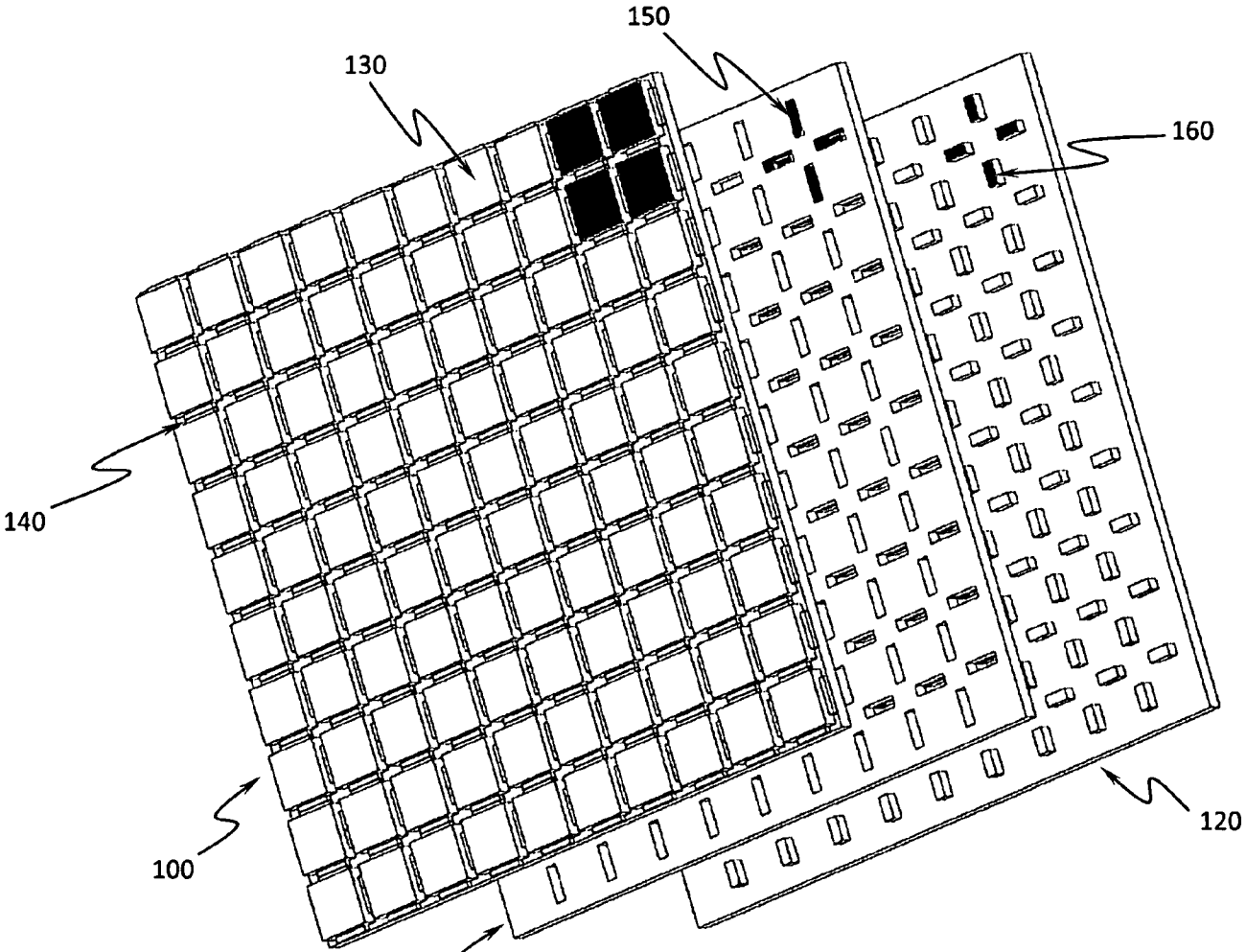
FIG. 1 depicts the three principle layers of the present invention's antenna structure as viewed from the front side radiating surface.

Referring to FIG. 1, the antenna surface 100 is uniformly covered with a dense array of individual very closely spaced electrically conductive segments or "pixels" 130 (preferably a thin metal layer and square in shape) each joined to each of its adjacent segments by a comparatively narrow (square or rectangular) photoconductive connector 140 which is in electrical contact with (or actually overlaps) any two adjacent metallic segments 130, thus filling in the narrow gap between them. Each photoconductive connector 140 is comprised of a photoconductive material made up of CdS, or some variation thereof or substitution therefore, which is optimized in chemical composition and physical structure of the connector to have a very high electrical conductivity when exposed to light, and which becomes virtually non-conductive in the absence of light. A brief literature search indicates that a dynamic range of up to $10^6$ (ie 0.1 ohm "on state" to 100K ohm "off state") is readily available with off-the shelf photoconductive material technology.

Still referring to FIG. 1, additionally, a coplanar array of light-emitting elements (LEDs or laser diodes) 160, each of whose outputs is co-aligned and confined to the area of its mating photoconductive connector 140 is closely coupled to the underside of antenna surface 100 (i.e., non-RF-emitting side). Thus, a continuous electrically conductive patch or pattern of patches (comprised of the electrically conductive segments 130 joined by their adjacent photoconductive connectors 140) making up a microstrip antenna element or multiple elements, as well as associated strip lines, feeds, etc. can be created on the antenna (RF-emitting) surface 100 by activating the corresponding pattern of LED's 160 in the coplanar underside array 120.

With regard to routing signals into and out of the antenna, one skilled in the art would note that numerous methods can be employed to establish connection of the antenna to a radio frequency transmission/reception source, including single or multiple connection points to the antenna. For example, metallic segments similar in composition and thickness to metallic segments 130, as well as on the same RF emitting/receiving surface of antenna surface 100, but being typically much larger in size, and potentially of a different shape could be added for the purpose of providing RF entry point connections for connecting external RF cable or waveguide for transmitting power to the antenna, or collecting power received by the antenna.

Additionally, it may also be advantageous or desirable to incorporate fixed electrical elements (not shown) such as surface-mounted components (i.e., resistors, capacitors, inductors) into antenna surface 100 for purposes such as impedance matching.

Note that the required ground plane could be placed either above or below the plane of the LED array 120; in the former case, holes 150 would be placed in the ground plane 110 to allow the light from each LED 160 to reach its corresponding photoconductive connector 140. It should further be understood that even though the front side of layer 100 is typically referred to as the RF-emitting side, it could also function as an RF receiver, or both emitter and receiver simultaneously.

The resolution of the conductive pattern on the antenna surface 100 will be limited by the size of the individual, photoconductively-connected metallic segments 130 which collectively comprise the active area(s) of the antenna. Basic physics requires that the size of the metallic segments be no larger than about $\frac{1}{10}\lambda$ for the highest frequency supported in order not to sacrifice antenna efficiency. It is evident from the foregoing that any conductive shape, having this limited resolution, can be sequentially "projected" on the antenna surface at a rate only constrained by the time constant of the photoconductive material used to form the connections (photoconductive connectors 140) between the metallic segments 130. Thus, although the time constant for existing photoconductors is relatively high compared to many semiconductor materials, it is reasonable to assume that the connectors could be switched fast enough to reconfigure (re-pattern) the antenna at a rate of at least ten to twenty times per second. This would be sufficient to support most applications such as an airborne, ground, or sea-vehicle based satellite communications link for Communications-On-The-Move.

To complete the antenna system of the present invention, software control of the array of LEDs 160 is utilized to pattern the antenna surface 100 in response to user inputs such as frequency band, beam shape (including single or multiple beams), and pointing direction, as well as sensor feedback to correct for platform position, motion, and vibration. This problem is readily solvable using conventional software control system design, and while the element of software control is part of the present invention, the details for the implementation of any particular software control scheme is not disclosed herein.

Among the many benefits of the present invention is the apparent ease of large antenna area and large scale fabrication using established processing techniques. Unlike conventional phased array approaches, the present invention could be orders of magnitude less expensive and complex. It would also have an inherently higher modulation bandwidth, lower power consumption, and be much thinner and lighter in weight. It would thus also be very easy to make conformal to almost any curvature and be well-adapted to deployment on any airborne platform. Because these processing techniques are scalable to very small dimensions, it should also be possible to fabricate an antenna that can operate efficiently up to at least 80 GHz.

Figure 2:
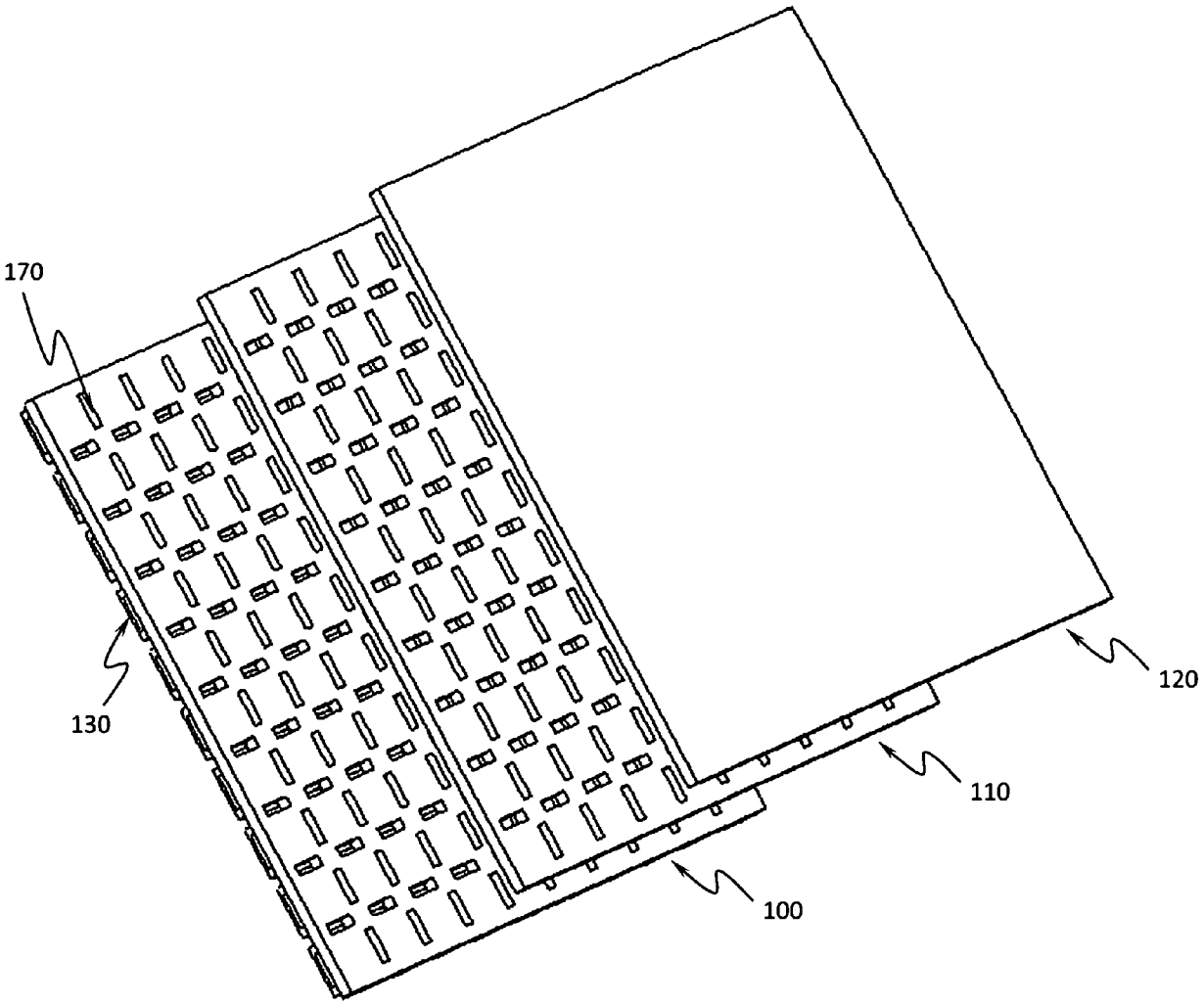
FIG. 2 depicts the three principle layers of the present invention's antenna structure as viewed from the backside non-radiating surface.

Referring to both FIG. 1 and FIG. 2, depicts a preferred embodiment of the present invention showing what could be a whole, or merely a small square portion of a large antenna implementation. The dimensions are somewhat relative only, with actual dimensions dependent on desired maximum frequency, properties of the materials employed, antenna application, and fabrication techniques used in manufacturing the antenna. Both FIG. 1 and FIG. 2 considered together depict an assembly of three basic layers 100, 110, and 120 that comprise the antenna in the preferred embodiment. FIG. 1 depicts the invention with the RF-emitting side of the antenna 100 facing while FIG. 2 depicts the invention with the rear or non-RF emitting, LED array side 120 facing. The three layers would be closely bonded together in the completed product, thus forming a potentially very thin and possibly very flexible, dynamically reconfigurable antenna under software control.

Again referring to FIG. 1 and FIG. 2, note first that elements 130 and 140 represent any of the metallic segments or photoconductive connector components, respectively, comprising the front (RF-emitting) surface 100 of the antenna. These are essentially deposited on to the emitting surface 100. The emitting surface 100 is a sheet of dielectric material which is either transparent to the light emitted from the LEDs 160 contained in the non-RF emitting, LED array side 120, or alternately, perforated with a plurality of holes 170, being located to correspond to each LED 160, to allow light from each LED 160 to illuminate its corresponding photoconductive connector 140 which electrically bridges the gap between each metallic segment 130 on the antenna RF-emitting surface 100. Middle layer 110 is a metallic sheet which forms the ground plane of the antenna. The middle layer ground plane 110 contains an array of through-holes 150 being located to correspond to each LED 160 and photoconductive connector 140, to allow light from the LEDs 160 to illuminate the photoconductive connectors 140, causing an electrically conductive path to form between corresponding adjacent metallic segments 130 when given LEDs 160 are turned on by software control. The array of LEDs 160 corresponding to through-holes 150 and photoconductive connectors 140 are resident on the LED array layer 120, which is a sheet of appropriate material to contain the LEDs 160, and preferably as well as the power and control circuitry necessary to interface with software commands that create the desired lighted "antenna image pattern" on the array of LEDs 160, and thus the corresponding electrically conductive pattern from the metallic segments 130 on the radiating surface 100 of the antenna.

A very simple example of this relationship is shown in FIG. 1, in which four metallic segments 130 comprising the upper right hand corner (shaded black) of the antenna radiating surface 100 are depicted as being melded into one electrically-continuous unit by light emitted by the four shaded black LEDs 160 shown in the upper right hand corner of the array of LEDs layer 120, with the light passing through corresponding through holes 150 (shaded black) in the upper right hand corner of the middle layer ground plane 110, and illuminating the corresponding four photoconductive connectors 140 (not shaded) in the upper right hand corner of the antenna radiating surface 100. It is obvious that the array of LEDs 160 shown could be replaced by any light-emitting display of the appropriate spectral content and power needed to activate the photoconductive connectors 140.

How the antenna efficiency will be impacted by such parameters as metallic segment 130 spacing and dynamic range (i.e., on-off conductivity ratio) of available or realizable photoconductive materials that could be used to form the photoconductive connectors 140 is as yet unknown. These parameters will be initially evaluated by constructing an equivalent-circuit hardware model comprising a simple low-frequency (1 GHz to 3 GHz) single patch antenna comprised of a 3-by-3 or 4-by-4 metallic segment 130 array 100 connected by resistors of a value simulating either the on or off conductivity of a readily-available photoconductive material that could be used to provide the same function over the same gap-width between the segments. The antenna could be constructed from a double-sided copper-clad PC board; one side etched/machined to form the segments, and the other left solid to form the ground plane 110. Clearance holes (larger than the resistor lead on the ground plane side) would be drilled in the board to solder the resistors between each adjacent segment, with the resistors mounted from the ground plane side and each lead soldered to its corresponding segment on the segment side. This antenna will be tested in an anechoic chamber and its performance compared to a solid (non-segmented) version of the same antenna.

Having described preferred embodiments of the invention with reference to the accompanying drawings, it is to be understood that the invention is not limited to those precise embodiments, and that various changes and modifications may be effected therein by one skilled in the art without departing from the scope or spirit of the invention as defined in the appended claims.

What is claimed is:

1. An antenna, comprising:
a radiating layer;
a ground plane layer; and
a control layer; wherein
said radiating layer further comprises
a plurality of radiating elements; and
a means for establishing and de-establishing electrical connectivity between adjacent said radiating elements;
said control layer comprises a plurality of means for producing and transmitting a control signal to said means for establishing and de-establishing electrical connectivity; and
said ground plane layer cooperates between said radiating layer and said control layer so as to facilitate the propagation of said control signal.

2. Said antenna of claim 1, wherein each of said plurality of radiating elements comprises a conductive structure fabricated onto a substrate.

3. Said antenna of claim 1, wherein said ground plane layer further comprises a plurality of channels so as to facilitate the propagation of said control signal.

4. Said antenna of claim 3, wherein each of said plurality of channels corresponds in number and orientation to each of said means for establishing and de-establishing electrical connectivity.

5. Said antenna of claim 1 wherein said control signal comprises light.

6. Said antenna of claim 1, wherein each of said plurality of means for producing and transmitting a control signal further comprises light emitting diodes.

7. Said antenna of claim 6, wherein each of said plurality of means for producing and transmitting a control signal corresponds in number and orientation to each of said means for establishing and de-establishing electrical connectivity.

8. Said antenna of claim 3, wherein each of said plurality of channels support the transmission of light of any frequency.

9. Said antenna of claim 1, wherein each of said plurality of means for producing and transmitting a control signal is responsive to computer commands, wherein said computer commands are in turn responsive to software control.

10. Said antenna of claim 1, wherein said means for establishing and de-establishing electrical connectivity are photosensitive conducting materials.

11. Said antenna of claim 10, wherein said photosensitive conducting materials are responsive to light from light emitting diodes.

12. Said antenna of claim 1, wherein said radiating layer, said ground plane layer, and said control layer comprise a co-planar, vertical stack, arranged in that respective order.

13. Said antenna of claim 12, being conformable.

14. An antenna comprising:
a top layer comprising:
a plurality of radiating elements; and
an array of photoconductive interconnections disposing an interruptable electrical pathway between adjacent said radiating elements;
a bottom layer comprising an array of light emitting sources; and
a middle layer comprising a ground plane having an array of light-transmissive channels; wherein,
each of said photoconductive interconnections, each of said light emitting sources, and each of said light-transmissive channels are oriented so as to permit light from a light emitting source to pass through a corresponding light-transmissive channel, and into a corresponding photoconductive interconnection; and
wherein each of said light emitting sources is individually computer software controlled.

15. Said antenna of claim 14 wherein said light-transmissive channels further comprise means to support the transmission of light of any frequency.

* * * * *